United States Patent [19]

Ridley

[11] 4,344,484

[45] Aug. 17, 1982

[54] DETERMINING THE LOCUS OF A PROCESSING ZONE IN AN IN SITU OIL SHALE RETORT THROUGH A WELL IN THE FORMATION ADJACENT THE RETORT

[75] Inventor: Richard D. Ridley, Bakersfield, Calif.

[73] Assignee: Occidental Oil Shale, Inc., Grand Junction, Colo.

[21] Appl. No.: 217,992

[22] Filed: Dec. 18, 1980

Related U.S. Application Data

[63] Continuation of Ser. No. 934,625, Aug. 17, 1978, abandoned.

[51] Int. Cl.[3] ..... E21B 43/243; E21B 43/247; E21B 47/06

[52] U.S. Cl. ..... 166/251; 166/64; 166/65 R; 166/259

[58] Field of Search ..... 166/251, 64, 252, 65 R, 166/256, 258, 259; 299/2

[56] References Cited

U.S. PATENT DOCUMENTS

| | | | |
|---|---|---|---|
| 3,032,102 | 5/1962 | Parker | 166/251 |
| 3,072,184 | 1/1963 | Parker | 166/251 |
| 3,227,215 | 1/1966 | Marx | 166/64 X |
| 3,454,365 | 7/1969 | Lumpkin et al. | 166/251 UX |
| 3,467,189 | 9/1969 | Dingley | 166/251 |
| 3,483,730 | 12/1969 | Gilchrist et al. | 166/251 X |
| 3,489,217 | 1/1970 | Gilchrist | 166/251 X |
| 3,490,529 | 1/1970 | Parker | 166/256 |
| 3,499,489 | 3/1970 | Parker | 166/258 |
| 3,661,423 | 5/1972 | Garrett | 299/2 |
| 3,892,270 | 7/1975 | Lindquist | 166/251 |
| 4,043,595 | 8/1977 | French | 299/2 |
| 4,043,596 | 8/1977 | Ridley | 299/2 |
| 4,043,597 | 8/1977 | French | 299/2 |
| 4,043,598 | 8/1977 | French et al. | 299/2 |
| 4,082,145 | 4/1978 | Elkington | 166/251 |
| 4,120,354 | 10/1978 | Ridley et al. | 166/252 X |

OTHER PUBLICATIONS

Reed, Frank, *Study of the Production of Shale Oil From Oil Shale in Wurtemberg*, Joint Intelligence Objective Agency, Translated from Fiat Final Report No. 447, Oct. 31, 1945, Office of Military Government for Germany (U.S.), Office of the Director of Intelligence, Technical Translation Service, Sandia Laboratories, Albuquerque, N.M., May 1977, pp. 1-89.

Feder, "Infrared Sensing: New Way to Track Thermal Flood Fronts", *World Oil*, Apr. 1967, pp. 142, 145, 146, 149 and 151.

van Poollen, "Transient Tests Find Fire Front in an In Situ Combustion Project", *The Oil and Gas Journal*, Feb. 1, 1965, pp. 78-80.

*Primary Examiner*—Stephen J. Novosad

*Attorney, Agent, or Firm*—Christie, Parker & Hale

[57] ABSTRACT

The locus of a processing zone advancing through a fragmented permeable mass of formation particles in an in situ oil shale retort in a subterranean formation containing oil shale is determined by monitoring in a well extending through unfragmented formation adjacent the retort, for condition in the retort affected by the advancement of such a processing zone through the retort. Monitoring can be effected by placing means for monitoring such a condition in such a well extending through unfragmented formation adjacent the retort.

20 Claims, 2 Drawing Figures

DETERMINING THE LOCUS OF A PROCESSING ZONE IN AN IN SITU OIL SHALE RETORT THROUGH A WELL IN THE FORMATION ADJACENT THE RETORT

CROSS REFERENCE TO RELATED APPLICATIONS

This is a continuation of application Ser. No. 934,625, filed Aug. 17, 1978, now abandoned.

CROSS-REFERENCES

This application is related to U.S. patent application Ser. No. 798,076, filed on May 18, 1977, by W. Brice Elkington, now U.S. Pat. No. 4,082,145, entitled DETERMINING THE LOCUS OF A PROCESSING ZONE IN AN IN SITU OIL SHALE RETORT BY SOUND MONITORING; U.S. patent application Ser. No. 803,363, filed on June 3, 1977, by Richard D. Ridley and Robert S. Burton, now U.S. Pat. No. 4,120,354, entitled DETERMINING THE LOCUS OF A PROCESSING ZONE IN AN IN SITU OIL SHALE RETORT BY PRESSURE MONITORING; and U.S. patent application Ser. No. 796,700, filed on May 13, 1977 by Gordon B. French, now U.S. Pat. No. 4,151,877, entitled DETERMINING THE LOCUS OF A PROCESSING ZONE IN A RETORT THROUGH CHANNELS, all of which are assigned to the assignee of this invention and incorporated herein by this reference.

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit having layers containing an organic polymer called "kerogen," which upon heating decomposes to produce liquid and gaseous products. It is the formation containing kerogen that is called "oil shale" herein, and the liquid product which contains hydrocarbonaceous liquids is called "shale oil."

A number of methods have been proposed for processing oil shale which involve either first mining the kerogen bearing shale and processing the shale above ground, or processing the oil shale in situ. The latter approach is preferable from the standpoint of environmental impact since the spent shale remains in place, reducing the chance of surface contamination, surface distortion, and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598 which are incorporated herein by this reference. Such patents describe in situ recovery of liquid and gaseous materials from a subterranean formation containing oil shale by mining out a portion of the subterranean formation and then fragmenting a portion of the remaining formation to form a stationary, fragmented permeable mass of formation particles containing oil shale, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of an oxygen-containing retort inlet mixture into the retort as a gaseous combustion zone feed to advance the combustion zone through the retort. In the combustion zone, oxygen in the combustion zone feed is depleted by reaction with hot carbonaceous materials to produce heat and combustion gas. By the continued introduction of the gaseous combustion zone feed into the combustion zone, the combustion zone is advanced through the retort. The combustion zone is maintained at a temperature lower than the fusion temperature of oil shale, which is about 2100° F., to avoid plugging of the retort, and above about 1100° F. for efficient recovery of products from the oil shale.

The effluent gas from the combustion zone comprises combustion gas and any gaseous portion of the combustion zone feed that does not take part in the combustion process. This effluent gas is essentially free of free ozygen and contains constituents such as oxides of carbon and sulfurous compounds. It passes through the fragmented mass in the retort on the advancing side of the combustion zone to heat oil shale in a retorting zone to a temperature sufficient to produce kerogen decomposition, called retorting, in the oil shale to gaseous and liquid products and to a solid carbonaceous residue.

The liquid products and gaseous products are cooled by cooler particles in the fragmented mass in the retort on the advancing side of the retorting zone. Liquid products, together with water produced in or added to the retort, are collected at the bottom of the retort and withdrawn to the surface through an access tunnel, drift or shaft. An off gas containing combustion gas generated in the combustion zone, gaseous products produced in the retorting zone, gas from carbonate decomposition, and any gaseous portion of the combustion zone feed that does not take part in the combustion process is also withdrawn to the surface.

It is desirable to know the locus of parts of the combustion and retorting processing zones as they advance through an in situ oil shale retort for many reasons. One reason is that by knowing the locus of such a processing zone, steps can be taken to control the orientation of the advancing side of the processing zone. It is desirable to maintain a processing zone which is flat and uniformly transverse and preferably uniformly normal to the direction of its advancement. If the combustion zone is skewed relative to its direction of advancement, there is more tendency for oxygen to be present in the combustion zone, thereby reducing hydrocarbon yield. In addition, with a skewed processing zone, more cracking of the hydrocarbon products can result. Monitoring the locus of parts of the processing zone provides information for control of the advancement of the processing zone to maintain it flat and uniformly perpendicular to the direction of its advancement to obtain high yield of products.

Another reason for which it can be desirable to monitor the locus of a processing zone is to provide information so the composition of the combustion zone feed mixture can be varied with variations in the kerogen content of oil shale being retorted. Formation containing oil shale includes horizontal strata or beds of varying kerogen content, including strata containing substantially no kerogen, and strata having a relatively high kerogen content such as strata having a Fischer assay of 80 gallons per ton. If a combustion zone feed containing too high a concentration of oxygen is introduced into a region of a retort containing oil shale having a high kerogen content, oxidation of carbonaceous material in the oil shale can generate sufficient heat that fusion of the oil shale can result, thereby producing a region of the fragmented mass which cannot be penetrated by processing gases. High temperatures can also cause excessive endothermic carbonate decomposition to carbon dioxide and dilution of the off gas from the retort, thereby lowering the heating value of the off gas. Layers in the fragmented mass inherently correlate with strata in the unfragmented formation because there is little vertical mixing between strata when explosively fragmenting formation to form a fragmented permeable mass of formation particles. Therefore, samples of various strata through the retort can be taken before initiating retorting of the oil shale and assays can be conducted thereon to determine the kerogen content. Such samples can be taken from the fragmented mass, from formation before expansion, or from formation nearby the fragmented mass since little change in kerogen content of oil shale occurs over large areas of formation. Then, by monitoring the locus of the combustion zone as it advances through the retort, the composition of the conbustion zone feed can be appropriately modified.

Another reason for monitoring the locus of the combustion and retorting processing zones as they advance through the retort is to monitor the performance of the retort to determine if sufficient shale oil is being produced in relation to the amount of oil shale being retorted.

Further, by monitoring the locus of the combustion and retorting processing zones, it is possible to control the advancement of these two zones through the retort at an optimum rate. The rate of advancement of the combustion and retorting processing zones through the retort can be controlled by varying the flow rate and composition of the combustion zone feed. Knowledge of the locus of the combustion and retorting processing zones allows optimization of the rate of advancement to produce hydrocarbon products at the lowest cost possible with cognizance of the overall yield, fixed costs, and variable costs of producing the products.

Thus, it is desirable to provide a method for determining the locus of a processing zone advancing through an in situ oil shale retort.

SUMMARY OF THE INVENTION

The present invention concerns a method for determining the locus of a processing zone, such as a combustion zone or a retorting zone, advancing through a fragmented permeable mass of formation particles in an in situ oil shale retort in a subterranean formation containing oil shale, wherein gaseous and liquid products are produced during processing. The method comprises forming at least one monitoring well in unfragmented formation adjacent the retort. The monitoring well is separated from the retort by a zone of unfragmented formation. At least one condition affected by the advancement of the processing zone through the retort is monitored in the monitoring well. Liquid and gaseous products produced by the advancement of the processing zone through the retort are recovered from the advancing side of the processing zone.

Conditions in the retort which are affected by the advancement of a processing zone and which can be monitored in a monitoring well in unfragmented formation adjacent the retort include such conditions as pressure of fluid, temperature, sound and composition of fluid.

Monitoring can be effected by placing means for measuring at least one condition affected by the advancement of a processing zone through the retort in such a monitoring well. For monitoring the locus of a processing zone advancing downwardly through a fragmented mass, such means for measuring the conditions can be vertically spaced apart from each other within the monitoring well.

A plurality of monitoring wells can be formed adjacent the fragmented mass and separated therefrom by a zone of unfragmented formation. Each monitoring well can contain measuring means for monitoring the conditions affected by the advancement of a processing zone through the retort.

DRAWINGS

These and other features, aspects and advantages of the present invention will become more apparent upon consideration of the following description, appended claims and accompanying drawings wherein:

FIG. 1 schematically represents in vertical cross section an in situ oil shale retort with two vertically extending monitoring wells in unfragmented formation adjacent to the retort for monitoring conditions in the retort; and FIG. 2 schematically represents in vertical cross section another in situ oil shale retort with a vertically extending monitoring well in unfragmented formation adjacent the fragmented mass and in fluid communication with the fragmented mass for monitoring conditions in the retort.

Figure 1:
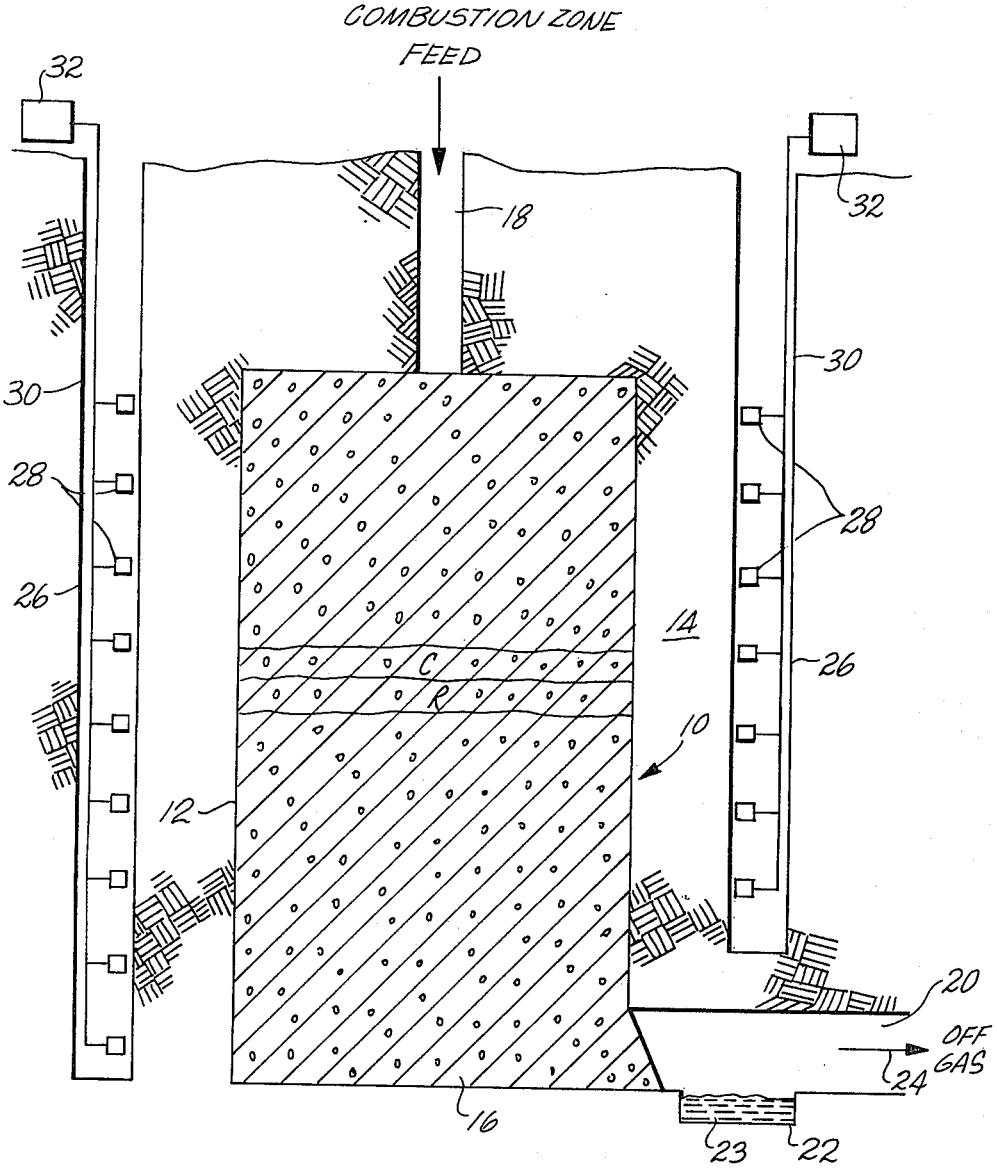
Referring to FIGS. 1 and 2, an in situ oil shale retort 10 is in the form of a cavity 12 formed in a subterranean formation 14 containing oil shale. The cavity contains a fragmented permeable mass 16 of formation particles containing oil shale. The cavity 12 can be created simultaneously with the fragmentation forming the mass 16 of formation particles by blasting, utilizing any of a variety of techniques. A desirable technique involves excavating or mining a void within the boundaries of an in situ oil shale retort site to be formed in the subterranean formation and explosively expanding remaining oil shale in the formation toward such a void. A method of forming an in situ oil shale retort is described in the aforementioned U.S. Pat. Nos. 3,661,423; 4,043,595 and 4,043,596. A variety of other techniques can also be used.

A conduit 18 communicates with the top of the fragmented mass 16 of formation particles. During the retorting operation of the retort 10, a combustion processing zone C is established in the retort and advanced by introducing an oxygen containing retort inlet mixture such as air or air mixed with other fluids, into the in situ oil shale retort through the conduit 18 as a combustion zone feed. The combustion processing zone is that portion of the retort wherein the greater part of the oxygen in the combustion zone feed that reacts with residual carbonaceous material in retorted oil shale is consumed. Oxygen introduced to the retort in the combustion zone feed oxidizes carbonaceous material in the oil shale to produce combustion gas. Heat from the exothermic oxidation reactions, carried by flowing gases, advances the combustion zone through the fragmented mass of formation particles.

Combustion gas produced in the combustion zone and any unreacted portion of the combustion zone feed pass through the fragmented mass of formation particles on the advancing side of the combustion zone establishing a retorting processing zone R on such advancing side of the combustion zone. Kerogen in the oil shale is retorted in the retorting zone to produce liquid and gaseous products.

There is an access tunnel, adit, drift, or the like 20 in communication with the bottom of the retort. The drift contains a sump 22 in which liquid products 23, including water and liquid hydrocarbon containing products are collected to be withdrawn. An off gas 24 containing gaseous products, combustion gas, carbon dioxide from carbonate decomposition, and any unreacted gaseous portion of the combustion zone feed is also withdrawn from the in situ oil shale retort 10 by way of the drift 20. The liquid products and off gas are withdrawn from the retort as effluent fluids.

Retorting of oil shale can be conducted with combustion zone temperatures as low as about 800° F. However, for economically efficient retorting, it is preferred to maintain the combustion zone at least at about 1100° F. The upper limit for the temperature in the combustion zone is determined by the fusion temperature of oil shale, which is about 2100° F. The temperature in the combustion zone preferably is maintained below about 1800° F. to provide a margin of safety between the temperature in the combustion zone and the fusion temperature of the oil shale.

An exemplary embodiment of an in situ oil shale retort which can be used in the method for determining the locus of a processing zone advancing therethrough is shown in FIG. 1. In FIG. 1 two monitoring wells 26 extend through unfragmented subterranean formation 14 adjacent the fragmented permeable mass 16 in the retort 12. The term "well" as used herein refers to any excavation either vertically, horizontally or diagonally extending which encompasses the normal definition of "well" as used in the mining industry and includes such additional excavations as shafts, tunnels, bore holes, both cased and uncased, drifts and the like. The method for determining the locus of a processing zone can be practiced using a plurality of such monitoring wells 26 extending through the unfragmented formation adjacent the fragmented permeable mass in such a retort.

It is preferred that monitoring well 26 be formed following the explosive formation of fragmented mass 16 to prevent collapse of the monitoring well 26 or substantial fracturing of the unfragmented formation 14 lying between the fragmented mass 16 and the monitoring well during the explosive expansion process.

Figure 2:
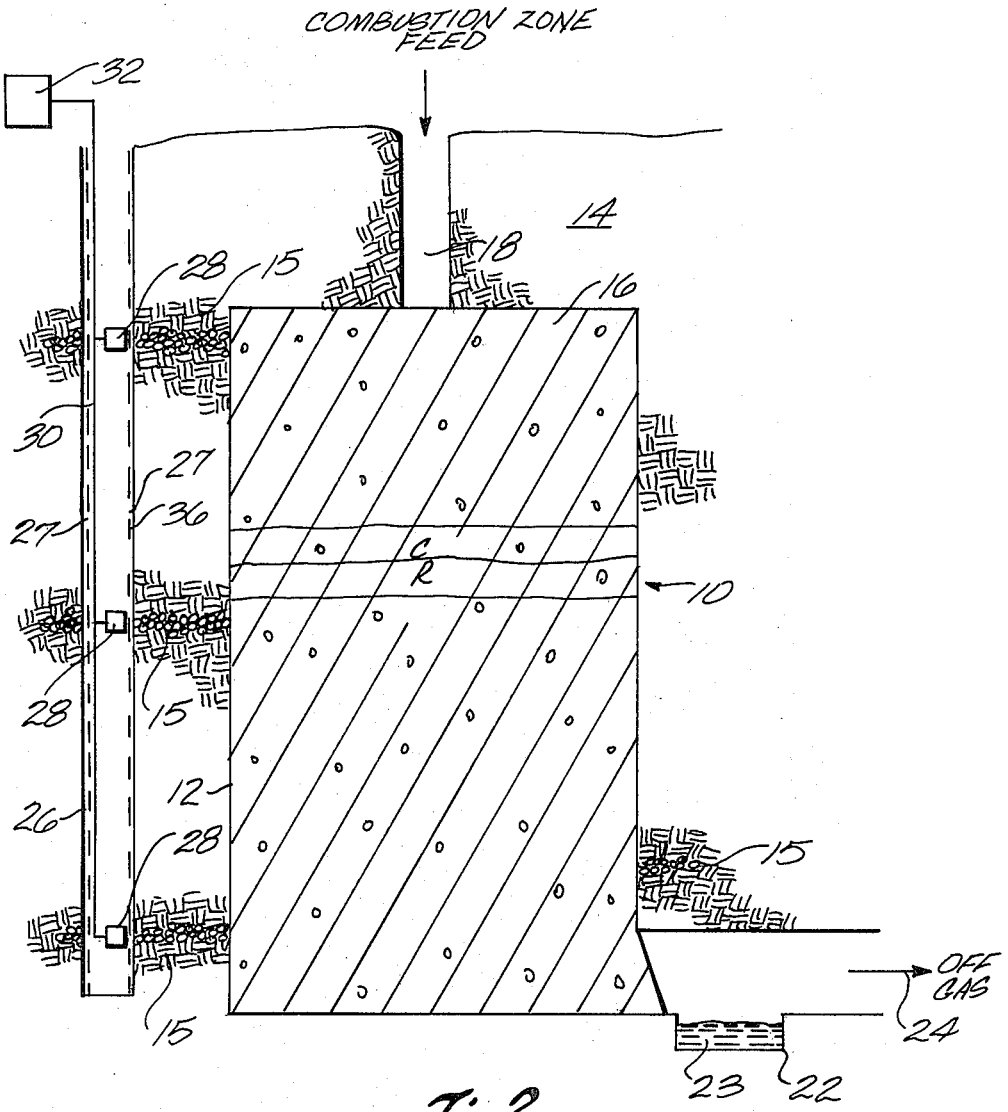

The monitoring wells 26 are not shown to scale in FIG. 1 or in FIG. 2. A monitoring well can be much smaller in relation to the retort than indicated in the drawings. For example, for a retort having a square horizontal cross section 120 feet on a side, a monitoring well can be as small as 6 inches in diameter, or such monitoring well can be larger. For ease of illustration, description and in order to show the components within the monitoring wells, the monitoring wells schematically illustrated in FIGS. 1 and 2 have been enlarged.

The monitoring wells 26 can be formed by boring a hole through the unfragmented formation 14 adjacent the fragmented mass 16 of retort 12. When boring a bore hole through the unfragmented formation 14 adjacent the retort 12, care is taken to leave a zone of unfragmented formation between the bore hole and the fragmented mass 16. The zone of unfragmented formation 14 between the monitoring well 26 and the fragmented mass 16 is sufficiently thick that the high temperatures experienced in the fragmented mass are not experienced in the monitoring wells. The unfragmented formation 14 between the monitoring well and the fragmented mass is sufficiently thin to allow measurement within the monitoring well of at least one condition in the fragmented mass affected by the locus of a processing zone. For example, the monitoring well is formed leaving from about 2 to about 20 feet of unfragmented formation between the monitoring well and the fragmented mass.

Within the monitoring well is placed monitoring means 28 for measuring at least one condition affected by the advancement of a processing zone through the fragmented mass 16 of the retort 12. Monitoring within the well is conducted at a location parallel and corresponding to a location in the fragmented mass between the combustion zone feed inlet and the product withdrawal outlet. Such monitoring means 28 can be means for measuring such conditions in the retort as temperature, pressure, sound production or composition of fluids from the retort. Monitoring means 28 can include temperature transducers, pressure transducers, sound transducers and gas sampling devices.

The bore hole adjacent the fragmented mass can be enlarged by subsequent boring or by explosive expansion to form a monitoring well of sufficient size to enable placement of the monitoring means 28 within the monitoring well. Due to conditions within the unfragmented formation 14 wherein the monitoring well is formed, the monitoring well 26 can be cased or uncased.

The monitoring well provides a reasonably nonhostile area from which to monitor conditions affected by a processing zone advancing through the fragmented mass. Such conditions affected can be temperature, pressure, sound production and variations in fluid compositions in the fragmented mass. The high temperature and corrosive environment present in the retort are not present to the same degree in the unfragmented formation adjacent the retort. Therefore, monitoring means 28 placed in the monitoring well such as a temperature transducer, pressure transducer, sound transducer and gas sampling device need not be constructed of material that would have to withstand the high temperature and hostile environment present within the retort during the retorting process. Thus, the monitoring means 28 can be constructed from low performance materials and low cost materials such as carbon steel.

Preferably, more than one monitoring well 26 is formed in the unfragmented formation adjacent the fragmented mass 16 as is shown in FIG. 1. Providing a plurality of such monitoring wells extending through the unfragmented formation adjacent the fragmented mass permits determination of whether a processing zone advancing through the fragmented mass is skewed or uniformly transverse to its direction of advancement. The monitoring means 28 are placed within each of the plurality of monitoring wells. The placement of monitoring means 28 within separate monitoring wells 26 at the same elevation within the subterranean formation allows determination of whether a processing zone advancing through the fragmented mass is skewed or uniformly transverse to its direction of advancement. If the processing zone is detected by only one of the monitoring means at a selected elevation, this indicates that the processing zone is skewed. If the processing zone is detected simultaneously by two monitoring means 28 at the same elevation but within different monitoring wells, this indicates that the processing zone is uniformly transverse to its direction of advancement.

More preferably, a plurality of such monitoring means 28 are placed within each of the monitoring wells 26 formed adjacent the fragmented mass in order to monitor the advancement of the processing zone during the entire retorting process. When a plurality of monitoring means 28 is placed within a monitoring well or plurality of monitoring wells, such monitoring means are spaced apart within the well along the direction of advancement of the processing zone. By having a plurality of such monitoring means 28, the advancement of the processing zone through the retort can be effectively monitored.

The conditions affected by the advancement of a processing zone can be monitored either by monitoring for only one condition or a mixture of conditions. Such monitoring of more than one condition can be conducted independently, simultaneously or sequentially. For example, within one monitoring well one condition can be monitored while in a separate well a different condition can be monitored or within one well such separate conditions can be monitored.

The unfragmented formation 14 in which the in situ oil shale retort 12 is formed can contain tuff beds. For example, FIG. 2 schematically shows an exemplary embodiment of an in situ oil shale retort formed within a formation having tuff beds 15 through a subterranean formation 14. The term "tuff beds" as used herein refers to any layer of formation which is permeable to the flow of gas and includes layers of formation which exhibit natural permeability and layers in which the permeability has been artificially produced. For example, such artificially produced permeability can be formed by using such techniques as are described in U.S. Pat. No. 4,045,085, issued Aug. 30, 1977 and incorporated herein by reference. This patent describes techniques which can be used for fracturing unfragmented formation between a bore hole and an in situ oil shale retort. Techniques which can be used include electrolinking, hydraulic fracturing, hydraulic fracturing with propping, and explosive fracturing. Each of these techniques is described in detail in U.S. Pat. No. 4,045,085. Unfragmented formation can be fractured by any one or a combination of these techniques.

The oil shale in the formation is substantially impervious to gas flow while the tuff beds are by definition permeable to gas flow. This is because the oil shale is compacted sedimentary formation while the tuff beds are uncompacted volcanic ash. The tuff beds shown in FIG. 2 lie in substantially horizontal strata and are substantially normal to the downward or upward advancement of a combustion zone and a retorting zone through the fragmented permeable mass of formation particles in the retort. The tuff beds 15 are in fluid communication with the fragmented permeable mass 16 of formation particles in the retort. The location of the tuff beds 15 can be determined when mining out a portion of the subterranean formation 14 for forming the retort 10 or by taking core samples of such formation.

The tuff beds 15 provide fluid communication through a zone of unfragmented formation between the fragmented mass 16 and the monitoring well 26 formed adjacent but separated from such fragmented mass. With fluid communication between the fragmented mass 16 and the monitoring well 26, monitoring devices 28 for measuring changes in the fluids present in the fragmented mass can be placed within the monitoring well 26. Fluid passing from the fragmented mass through the tuff beds into the monitoring well is then detected by the monitoring means 28 and by analysis of this fluid the locus of the processing zone can be determined.

The combustion zone feed introduced into the retort can be pressured into the retort by gas pumping means such as a blower (not shown). Alternatively or conjunctively with such a blower, gas withdrawing means such as a vacuum pump (not shown) can be used to withdraw off gas 24 from the retort and thereby create pressure less than ambient pressure throughout the retort to cause the combustion zone feed to enter the retort through conduit 18. Gas pumping means for introducing the combustion zone feed and off gas withdrawing means for withdrawing the off gas can be used in combination.

During the retorting operation the fragmented permeable mass 16 of formation particles undergoes thermal stresses due to temperature changes. Initially a particle in the fragmented mass is at ambient temperature. The particle is gradually heated to the temperature of the retorting zone and eventually the particle obtains the temperature of the combustion zone, which can be up to the fusion temperature of oil shale, which is about 2100° F., although the temperature for the combustion zone is preferably appreciably lower. As the combustion zone advances through the retort beyond the particle, the particle is cooled by the gaseous combustion zone feed.

This heating of a particle as the combustion zone and retorting zone advance through the fragmented mass and the subsequent cooling of the particle after the combustion zone and retorting zone have passed, can cause uneven expansion and contraction of the particle resulting in thermal stresses in the particle. These thermal stresses can result in cracking and exfoliation accompanied by characteristic sounds.

Other processes occurring in the retorting and combustion zones which can result in production of sound include release of volatilized hydrocarbons by decomposition of kerogen in the oil shale and release of carbon dioxide due to decomposition of carbonates of alkaline earth metals such as calcium and magnesium carbonates present in oil shale. These thermally induced reactions cause volume changes in the oil shale and gaseous products and induce stresses associated with diffusion through the oil shale. Retorted and combusted oil shale is found to have appreciable swelling and secondary cracking. It is well known that cracking and spallation of rock are accompanied by distinctive sounds.

The locus of the combustion zone C and/or retorting zone R as they advance through the fragmented permeable mass of formation particles, can be monitored by detecting sounds of characteristic amplitude, frequency, rise time and the like, occurring in the retorting and/or combustion processing zones of the retort where the thermally and chemically induced stresses are greatest. For example, it is known that when hydrocarbons are burned, they can produce characteristic sounds detectable at a frequency of about 125 hertz and at its harmonics of about 250 hertz and about 500 hertz. Monitoring is effected by placing one or more sound transducers adjacent the retort at selected elevations within at least one monitoring well.

For example, referring to FIG. 1, in an embodiment of this invention at least one monitoring well 26 extends through the unfragmented formation 14 adjacent the fragmented permeable mass 16 in retort 12. Within the monitoring well are a plurality of monitoring means 28 which can be sound transducers vertically spaced apart from each other. The sound transducers convert sound to an electrical output. Each of the sound transducers is connected to an electrical signal transfer means such as a multi-signal lead cable 30 connected to monitoring means 32 above ground. The locus of the combustion and/or retorting zone is monitored by noting signals from the sound transducers having a frequency, amplitude and/or rise time corresponding to that produced by the combustion or retorting zone.

The sound transducers used can be devices such as microphones or piezoelectric crystals having sufficient sensitivity to detect sounds produced in the retort. Monitoring of sound from a processing zone in the retort is desirable since the transducers can be located in the formation out of reach of adverse conditions in the fragmented mass in the retort. Sound is transmitted through the zone of unfragmented formation between the monitoring well and the fragmented mass.

Preferably more than one sound transducer is provided at a selected elevation in the monitoring well. Providing a plurality of sound transducers in separate monitoring wells extending through the formation adjacent the fragmented mass of the retort permits determination of whether a processing zone advancing through the fragmented permeable mass is skewed or uniformly transverse to its direction of advancement. If the processing zone is detected by only one sound transducer at a selected elevation, this indicates that the processing zone is skewed. If the processing zone is detected simultaneously by two sound transducers at the same elevation in separate monitoring wells, this indicates that the processing zone is uniformly transverse to its direction of advancement.

The following example illustrates monitoring the locus of a processing zone in an in situ oil shale retort using sound measuring means placed within a well formed in formation adjacent the retort site. Determining the locus of a processing zone using sound is also disclosed in the aforementioned U.S. Pat. No. 4,082,145.

Referring to FIG. 1 a retort 10 containing a fragmented permeable mass 16 of formation particles containing oil shale was formed in the south/southwest portion of the Piceance Creek structural basin in Colorado. The retort was about 120 feet square in cross section and about 270 feet deep. The top of the retort was under an overburden of about 400 feet. Three bore holes 26, each 6 inches in diameter, are drilled from ground level to the elevation of the bottom of the retort through unfragmented formation on the east, west, and north sides of the retort. Each bore hole is drilled about six feet from the center point of a wall of the retort. To monitor sound in the retort, a microphone, preamplifier, cable, and filter are obtained from B&K Instruments (Breul & Kjar Instruments) of Cleveland, Ohio. A microphone having a 3 decibel response in the range of 22 hertz to 15,000 hertz and an IT-21P preamplifier are connected to each other and are placed in a bore hole. Seven hundred feet of Belden three conductor cable is attached to the preamplifier and used to move the preamplifier and microphone up and down through a bore hole and to withdraw the microphone and preamplifier from one bore hole for insertion into another bore hole. At ground level, a tape recorder is provided. Sound recorded on tapes with the tape recorder are played back through a Third Octave Filter Set, model 1616, and measured by an Impulse Precision Sound Level Meter, model 2209. A recorder is provided for recording the outputs of the sound meter.

Another condition within the fragmented mass which is affected by the locus of the advancement of a processing zone is the pressure experienced within the fragmented mass. The pressure differential from the top to bottom for vertical movement of gas through the retort depends upon various parameters of the retort and retorting process such as void fraction, particle permeability, particle size, temperatures of the retorting and combustion zones, gas flow rates, and the like. For example, an in situ retort having about 20 percent void fraction and a height of 100 feet can have a pressure differential less than about 1 psi from top to bottom for vertical movement of gas down through the retort at about 1 scfm (standard cubic foot per minute) per square foot of horizontal cross section of the fragmented mass. Retorts having greater heights have proportionately larger pressure drops. For example, a retort of up to 1000 feet in height can be provided with a pressure differential of less than about 10 psi from top to bottom. As used herein void fraction is the ratio of the volume of the voids or spaces between particles in the fragmented mass to the total volume of the fragmented permeable mass of formation particles in an in situ oil shale retort.

The heating of the particles of the fragmented mass as the retorting and combustion zones advance through the fragmented mass causes swelling of the particles. Part of this swelling is temporary and results from thermal expansion, and part is permanent and is brought about by the retorting of kerogen in the shale. As the particles subsequently cool after the combustion zone has passed, the particles decrease in size by thermal contraction. The thermal swelling of particles in the retorting and combustion processing zones closes voids between particles and increases the overall volume of the mass of particles, thereby decreasing the void fraction. As the void fraction decreases, less cross-sectional area of the fragmented mass is available for gas flow. This smaller cross-sectional area available for gas flow is manifested by increased pressure drop across the hotter portions of the retort, and particularly the combustion zone.

Other processes occurring in the retorting and combustion zones which can affect the pressure profile in the retort include release of volatilized hydrocarbons by decomposition of kerogen in the oil shale and release of carbon dioxide due to decomposition of carbonates of alkaline earth metals such as calcium and magnesium carbonates present in oil shale. These thermally induced reactions increase the volumetric flow rate of gases on the advancing side of and in the retorting and combustion zones. This increase in volumetric flow rate tends to increase the pressure drop across the retorting and combustion zones. In addition, the viscosity of gases increases as their temperature increases. Therefore, heating of gases in the region of the retorting and combustion zones increases their viscosity and thereby increases the pressure drop across the retorting and combustion zones of the retort.

As used herein, pressure gradient refers to the change of pressure experienced by a gas passing through a selected volume of the fragmented mass (such as a volume of the fragmented mass which is one foot thick).

Since the combustion zone is the hottest region of the retort, and thereby can have the smallest void fraction and hottest gases flowing therethrough, it can be expected that the combustion zone has the highest pressure gradient in the retort. Similarly, the retorting zone has a high pressure gradient.

Therefore, the locus of the combustion zone C and/or retorting zone R as they advance through the fragmented permeable mass of particles, can be determined by monitoring the pressure in the retort 10 at selected locations outside the retort to determine changes in pressure gradient across portions of the retort. Monitoring can be effected by placing one or more pressure transducers adjacent to the retort at selected elevations within at least one monitoring well that is in fluid communication with the fragmented mass.

For example, referring to FIG. 2, at least one monitoring well such as an uncased bore hole or a cased bore hole with perforated casing 36, extends through the formation 14 adjacent the fragmented permeable mass 16 in retort 10. Because of the perforations 27 through the casing 36 and the natural permeability of the unfragmented formation 14, the interior of the casing 36 is in fluid communication with the retort. The natural permeability of the unfragmented formation can be enhanced by the presence of tuff beds 15 within the unfragmented formation. Fluid communication between the casing 36 and the retort can also be obtained by methods for artificially creating such fluid communication such as the use of shaped charges for perforating the casing 36 and forming openings through the unfragmented formation between casing 36 and retort 10. The technique of using shaped charges is known in the explosive art and is used for providing openings from petroleum formations into bore holes penetrating such formation. Therefore, the pressure along the length of the casing corresponds to the pressure along the length of the retort.

Within the monitoring well is a plurality of monitoring means 28 such as a pressure transducer. The pressure transducers are adapted to measure the pressure at a selected elevation in the monitoring well. Each pressure transducer, which converts pressure to an electrical output, is connected to an electrical signal transfer means such as a signal lead cable 30 connected to monitoring means 32 above ground. The locus of the combustion and/or retorting zone is monitored by noting signals from the pressure transducer to determine changes in pressure across selected elevations (pressure gradient) of the retort. For example, when the pressure measured with the pressure transducer increases relative to the inlet pressure of the gaseous combustion zone feed, this indicates that the portion of the retort adjacent the pressure transducer is undergoing increased pressure drop and therefore the retorting and combustion zones are advancing toward that elevation. When the pressure drop reaches a maximum, this indicates that the combustion zone is adjacent the pressure transducer. Conversely, as the pressure being monitored with the pressure transducer decreases relative to the gaseous combustion zone feed inlet pressure, this indicates that the combustion and retorting zones have passed the elevation of the retort adjacent such pressure transducer.

The pressure transducer can be a device such as an electrical pressure transducer of the strain gauge and piezoelectric type, a mechanical strain gauge such as a Bourdon gauge, and the like.

If only one stationary pressure transducer is used in the monitoring well, the location of a processing zone not proximate to the transducer can only be approximated. However, with a plurality of pressure transducers, the pressure at different elevations can be measured to accurately determine the locus of a processing zone.

Preferably more than one pressure transducer is provided at a selected elevation in the retort. Providing a plurality of pressure transducers at selected elevations in a plurality of monitoring wells extending through the formation adjacent the fragmented mass of the retort permits determination of whether a processing zone advancing through the fragmented permeable mass is skewed or uniformly transverse to its direction of advancement. If the pressure transducers at a selected elevation register different pressures, this indicates that the processing zone is skewed. Packers can be used between pressure transducers within a well for isolating each transducer so the pressure at selected elevations can be monitored. If the pressure transducers at the same elevation register substantially the same pressure, this indicates that the processing zone is uniformly transverse to its direction of advancement.

The method of determining the locus of a processing zone advancing through a retort can also be practiced by withdrawing a sample of gas from the retort and into a monitoring well adjacent the retort and in fluid communication with the fragmented permeable mass. By analyzing the composition of withdrawn gas for changes in its composition the locus of a processing zone can be determined.

For example, with reference again to FIG. 2, during the retorting operation, gases present in the retort can be withdrawn from the retort 10 through the zone of unfragmented formation and into the monitoring well 26. The gases can be withdrawn into the monitoring well through the unfragmented formation between the fragmented mass and the monitoring well due to the natural permeability of such formation, the presence of tuff beds 15 or artificially induced permeability such as by using shaped charges to form openings between the fragmented mass and the monitoring well.

Changes in the composition of the gases withdrawn to the monitoring well reflect changes in the composition of gases passing through the region of the retort at about the same elevation.

For example, initially at a selected region within a fragmented mass during the retorting process, there is a stable period when the region is traversed by off gas which contains constituents such as oxides of carbon, hydrogen, methane, ethane, nitrogen, propane, water vapor and hydrogen sulfide. As the retorting processing zone R approaches the region and the temperature of the region increases, the gases traversing the region contain increasing amounts of heavier hydrocarbons which subsequently condense on the cooler oil shale particles downstream of the region for collection in the sump 22 as part of the liquid product.

This general trend reaches its culmination when the retorting zone R reaches the region. As the retorting zone R advances through the region, the concentration of constituents generated in the retorting zone decreases in the gas passing through the region. Gaseous constituents generated in the retorting zone include hydrocarbons such as methane, ethane, and propane, and sulfurous compounds such as hydrogen sulfide. In addition, it is believed that some water vapor is released from formation particles during the retorting process and alkaline earth metal carbonates present in the oil shale can decompose to produce carbon dioxide. Therefore, as the retorting zone R passes through the region, the concentration of carbon dioxide, water vapor, hydrogen sulfide, hydrogen, and hydrocarbons in the gases passing through the region decreases.

As the combustion zone C advances through the region, the concentration of constituents consumed in the combustion zone increases in the gas traversing the region and the concentration of constituents generated in the combustion zone decreases. Thus the region is exposed to a gas containing an increasing concentration of oxygen. Constituents generated in the combustion zone can include carbon monoxide, water vapor, and carbon dioxide, both by oxidation of carbonaceous material in the oil shale and carbonate decomposition. Thus the region is exposed to a gas containing a decreasing concentration of these constituents as the combustion zone passes through it.

After the region is on the trailing side of the combustion zone C, the region is traversed by gas having substantially the composition of the combustion zone feed. Thus the composition of the gas passing through the region ordinarily changes only with changes in the composition of the combustion zone feed after the combustion zone has passed.

Within the monitoring well are a plurality of monitoring means 28 such as a gas sampling device. Each of the gas sampling devices is connected to gas transfer means (represented by line 30) which is connected to a gas analysis instrument (represented by box 32) above ground. When a casing is used, the casing is perforated adjacent the gas sampling device. Packers (not shown), such as used in oil wells can be used between adjacent gas sampling devices to isolate them from adjacent permeable layers. The locus of the combustion or retorting processing zones is determined by analyzing gas from each sampling device for its composition.

The pressure in the retort can be above, at, or below ambient pressure. If the retort is below ambient pressure it is necessary to suck a sample of gas through the zone of unfragmented formation and into the monitoring well. Thus, the gas sampling device can be devices such as suction nozzles assisted by suction means (not shown).

The above ground gas analysis instruments can be devices utilizing any of several analytical methods such as mass spectrometry, gas chromotography, infrared spectroscopy or wet chemical techniques.

Preferably, as with the monitoring of the other conditions, more than one gas sampling device is provided at a selected elevation in the retort by placement of such gas sampling devices in a plurality of monitoring wells adjacent the retort. This arrangement permits determination of whether a processing zone advancing through the fragmented permeable mass is skewed or perpendicular to its direction of advancement.

Another practice of the method of this invention can be illustrated with reference to FIG. 1. The locus of formation particles in an in situ oil shale retort can be determined by monitoring the temperature within the fragmented mass by placing one or more temperature transducers in a monitoring well adjacent the retort at selected locations.

The retorting zone and combustion zone within the fragmented mass have a significantly higher temperature than the ambient temperature of the fragmented mass. As the combustion zone advances through the retort beyond the particles, the particles are cooled by the gaseous combustion zone feed. Therefore, the locus of the combustion zone C and/or retorting zone R as they advance through the fragmented permeable mass of particles, can be determined by monitoring the temperature and temperature changes in the retort 10 at selected locations.

Monitoring can be effected by placing one or more temperature transducers at selected locations within a monitoring well adjacent the retort. The heat generated within the fragmented mass by the advancement of the combustion zone is transmitted through the unfragmented formation between the monitoring well and the fragmented mass. The actual temperature within the well is lower than the temperature in the fragmented mass because the unfragmented formation insulates the well from the high temperature within the retort. The temperature in the monitoring well concomitantly varies with the temperature and change of temperature of the fragmented mass. This change in temperature can be measured by the temperature transducers placed in the monitoring well.

For example, referring again to FIG. 1, at least one monitoring well 26 extends through the unfragmented formation 14 adjacent the fragmented permeable mass 16 in retort 12. Within the well are a plurality of measuring means 28 which can be temperature transducers, vertically spaced apart from each other. The temperature transducers convert temperature to an electrical output. Each of the temperature transducers is connected to an electrical signal transfer means 30 such as a multi-signal lead cable connected to monitoring means 32 above ground. The locus of the combustion or retorting zone is monitored by noting the temperature and temperature changes relayed from the temperature transducers and correlating those temperatures and temperature changes to the temperature and temperature changes produced by the combustion or retorting zone within the retort.

The temperature transducers used can be devices such as thermocouples and the like having sufficient sensitivity to detect temperature differentials in the unfragmented formation which correspond to temperature differentials within the fragmented mass.

Preferably more than one temperature transducer is provided at a selected elevation in the retort. Providing a plurality of temperature transducers at a selected elevation within a plurality of monitoring wells extending through the formation adjacent the fragmented mass permits determination of whether a processing zone advancing through the fragmented permeable mass is skewed or uniformly transverse to its direction of advancement.

Using a method such as the method of this invention to determine the locus of a processing zone such as a retorting zone R and a combustion zone C advancing through the fragmented permeable mass 16 in the retort 10 has significant advantages. For example, steps can be taken to maintain the combustion zone flat and minimize skewing of the combustion zone relative to its direction of advancement to minimize oxidation and excessive cracking of hydrocarbons produced in the retorting zone.

A particular advantage of the method of this invention is that no monitoring means needs to be positioned in the retort 10. Thus, the monitoring means used is not exposed to the high temperature and corrosive environment present in the retort. This allows use of a low cost conduit or casing formed from low performance materials such as carbon steel for the monitoring wells. In addition, special sampling equipment and gas carrying means requiring resistance to high temperatures and a corrosive environment are not required.

Although this invention has been described in considerable detail with reference to measuring certain conditions in the retort, the measurement of other conditions produced in other retorts is within the scope of this invention. For example, although the invention has been described in terms of a single in situ oil shale retort containing both a combustion processing zone and a retorting processing zone, it is possible to practice this invention with a retort containing only one processing zone, either a combustion or retorting zone. In addition, although the figures show a retort where the combustion and retorting zones are advancing downwardly through the retort, this invention is also useful for retorts where the combustion and retorting zones are advancing upwardly or transverse to the vertical.

Because of variations such as these, the spirit and scope of the appended claims should not be limited to the description of the preferred versions contained herein.

What is claimed:

1. A method for recovering gaseous and liquid products from an in situ oil shale retort in a subterranean formation containing oil shale, the in situ retort containing a fragmented permeable mass of particles containing oil shale and having boundaries of unfragmented formation, a combustion processing zone and a retorting processing zone advancing downwardly through the fragmented mass, wherein the advancement of the processing zone affects at least one condition within the fragmented mass, the method comprising the steps of:

forming at least one monitoring well in formation adjacent the retort, said monitoring well being separated from the fragmented permeable mass in the retort by a zone of unfragmented formation;

providing means for fluid communication through the unfragmented formation between the fragmented mass and such a monitoring well;

introducing into the in situ oil shale retort on the trailing side of the combustion processing zone a combustion zone feed to advance the combustion processing zone downwardly through the fragmented mass of particles and produce combustion gas in the combustion processing zone;

passing combustion gas and any unreacted portion of the combustion zone feed through the retorting processing zone in the fragmented mass of particles on the advancing side of the combustion processing zone, wherein oil shale is retorted and gaseous and liquid products are produced;

withdrawing liquid products and a retort off gas comprising said gaseous products, combustion gas and any gaseous unreacted portion of the combustion zone feed from the in situ oil shale retort from the advancing side of the retorting processing zone;

monitoring at a location in such monitoring well corresponding to a location in the fragmented mass between the combustion zone feed inlet and the product withdrawal outlet of the fragmented mass, at least one condition affected by at least one processing zone advancing through the fragmented mass and communicated to such a monitoring well via said means for fluid communication; and recovering liquid products and the gaseous products produced by the advancement of the processing zone through the retort.

2. A method as recited in claim 1 wherein at least one condition affected by the advancement of the combustion processing zone is monitored.

3. A method as recited in claim 1 wherein at least one condition affected by the advancement of the retorting processing zone is monitored.

4. A method as recited in claim 1 wherein at least one condition affected by the advancement of the processing zone is measured at a plurality of such locations within such a monitoring well.

5. A method as recited in claim 1 wherein at least one condition affected by the advancement of the processing zone is measured at a plurality of locations within a plurality of such monitoring wells.

6. A method as recited in claim 1 wherein the monitoring well extends in a direction parallel to the direction of advancement of the processing zone.

7. A method for determining the locus of at least one processing zone advancing through a fragmented permeable mass of formation particles containing oil shale in an in situ retort in a subterranean formation containing oil shale, the retort having a processing zone advancing therethrough affecting at least one condition within the retort, the method comprising the steps of:

forming at least one monitoring well for monitoring in such well at least one condition affected by the advancement of the processing zone advancing through the fragmented mass, such monitoring well extending through the subterranean formation adjacent the retort and separated from the retort by a zone of unfragmented formation;

providing means for fluid communication through the unfragmented formation between the fragmented mass and such a monitoring well; and monitoring in the monitoring well at least one condition affected by the advancement of the processing zone through the fragmented mass in the retort and communicated to such a monitoring well via said means for fluid communication.

8. A method as recited in claim 7 wherein the processing zone is a combustion zone.

9. A method as recited in claim 8 wherein a plurality of monitoring wells are formed in the formation adjacent the fragmented mass and at least one condition affected by the advancement of the processing zone is measured at a plurality of locations within each of the monitoring wells.

10. A method as recited in claim 8 wherein a plurality of monitoring wells are formed in the formation adjacent the fragmented mass and at least one condition affected by the advancement of the processing zone is measured in each monitoring well at about the same elevation within the subterranean formation.

11. A method as recited in claim 7 wherein the processing zone is a retorting zone.

12. A method as recited in claim 7 wherein at least one condition affected by the advancement of the processing zone is measured at a plurality of locations within such a monitoring well.

13. A method as recited in claim 7 wherein the monitoring well extends in a direction parallel to the direction of advancement of the processing zone.

14. In a method for recovering gaseous and liquid products from an in situ oil shale retort in a subterranean formation containing oil shale, the in situ retort containing a fragmented permeable mass of formation particles and having a processing zone advancing therethrough affecting at least one condition within the retort, wherein the method comprises the steps of introducing into the in situ oil shale retort on the trailing side of the processing zone a processing zone feed and withdrawing an off gas from the advancing side of the processing zone for advancing the processing zone through the fragmented mass of formation particles for producing liquid and gaseous products, and recovering the gaseous and liquid products from the retort on the advancing side of the processing zone, the improvement comprising the steps of:

forming at least one monitoring well extending through the subterranean formation adjacent the retort and separated from the fragmented mass in the retort by a zone of unfragmented formation;

providing means for fluid communication through the unfragmented formation between the fragmented mass and the monitoring well; and monitoring in such a monitoring well, at least one condition affected by the processing zone in the retort and communicated to such a monitoring well via said means for fluid communication.

15. A method as recited in claim 14 wherein the processing zone is a combustion zone.

16. A method as recited in claim 14 wherein the processing zone is a retorting zone.

17. A method as recited in claim 14 wherein at least one condition affected by the advancement of the processing zone is measured at a plurality of locations within the monitoring well.

18. A method as recited in claim 14 wherein a plurality of monitoring wells are formed in the formation adjacent the fragmented mass and at least one condition affected by the advancement of the processing zone is measured at a plurality of locations within each of the monitoring wells.

19. A method as recited in claim 14 wherein the monitoring well extends in a direction parallel to the direction of advancement of the processing zone.

20. A method for measuring a condition affected by a processing zone advancing through a fragmented permeable mass of formation particles containing oil shale in an in situ retort in a subterranean formation containing oil shale, the retort having a processing zone advancing therethrough affecting at least one condition within the retort, the method comprising the steps of:

forming at least one monitoring well for monitoring in such well at least one condition affected by the processing zone advancing through the fragmented mass, such monitoring well extending through the subterranean formation adjacent the retort and separated from the retort by a zone of unfragmented formation;

providing means for fluid communication through the unfragmented formation between the fragmented mass and such a monitoring well; and monitoring in the monitoring well for changes in at least one condition affected by the processing zone in the fragmented mass in the retort and communicated to such a monitoring well via the means for fluid communication.

* * * * *